US005921296A

United States Patent [19]

Porter et al.

[11] Patent Number: 5,921,296

[45] Date of Patent: Jul. 13, 1999

[54] FUNNEL WITH CONTAINER CONNECTION

[76] Inventors: Michael T. Porter, 22216 Victory Blvd., Apt C101, Woodland Hills, Calif. 91367; Darel H. Porter, 871 Glenway Ave. #6, Inglewood, Calif. 90302

[21] Appl. No.: 09/009,359

[22] Filed: Jan. 20, 1998

[51] Int. Cl.[6] ..... B67C 11/00

[52] U.S. Cl. ..... 141/340; 141/331; 141/383; 141/384

[58] Field of Search ..... 141/331, 340–342, 141/383, 384

[56] References Cited

U.S. PATENT DOCUMENTS

| | | | |
|---|---|---|---|
| D. 261,212 | 10/1981 | Mills | D7/68 |
| D. 306,951 | 4/1990 | Brändström et al. | D7/590 |
| 559,905 | 5/1896 | Pile | 141/331 |
| 3,987,943 | 10/1976 | Richmond, Jr. | 222/570 |
| 4,338,983 | 7/1982 | Hatcher | 141/331 |
| 4,856,568 | 8/1989 | Murphy et al. | 141/340 |
| 5,033,521 | 7/1991 | Martin | 141/341 |
| 5,402,835 | 4/1995 | Middleton | 141/331 |
| 5,472,025 | 12/1995 | Conrad et al. | 141/332 |
| 5,503,740 | 4/1996 | Callaghan et al. | 210/232 |

FOREIGN PATENT DOCUMENTS

| | | | |
|---|---|---|---|
| 2170121 | 7/1986 | United Kingdom | 141/331 |

*Primary Examiner*—J. Casimer Jacyna
*Attorney, Agent, or Firm*—David L. Volk

[57] ABSTRACT

A substantially cone shaped body comprises a top body opening and a bottom body opening. The top body opening is larger than the bottom body opening. A generally tubular threaded neck extends outwardly from the bottom body opening. At least one adapter has a threaded first end configured to removably mate with the neck. The adapter has a threaded second end adapted to removably mate with a receiving container opening. When the adapter is mated with the neck and with the receiving container opening, the bottom body opening is in fluid communication with the receiving container opening. A lid is provided for removably covering the top body opening.

2 Claims, 3 Drawing Sheets

FUNNEL WITH CONTAINER CONNECTION

BACKGROUND OF THE INVENTION

1. Field of the Invention

The present invention relates to funnels.

2. Description of the Related Art

Funnels of the prior art are of great assistance when a person is attempting to pour a liquid or particulate substance from a first container to a receiving container, particularly when the receiving container has a narrow opening.

When resting within the opening of the receiving container, ready for use, funnels of the prior art are subject to shifting and tipping to one side, potentially resulting in spillage, or even tipping over of the receiving container.

What is needed is a funnel which is fixedly connectable to containers of different sizes, to eliminate the shifting and tipping to one side which is possible with funnels of the prior art.

SUMMARY OF THE INVENTION

The funnel of the present invention includes a substantially cone shaped body comprising a top body opening and a bottom body opening. The top body opening is larger than the bottom body opening. A generally tubular threaded neck extends outwardly from the bottom body opening.

At least one adapter has a threaded first end configured to removably mate with the neck. The adapter has a threaded second end adapted to removably mate with a receiving container opening. When the adapter is mated with the neck and with the receiving container opening, the bottom body opening is in fluid communication with the receiving container opening. A lid is provided for removably covering the top body opening.

Because the adapter mates with the neck and with the receiving container, the funnel is fixedly and removably connectable to the receiving container, so that the funnel will not shift or tip to one side.

Because a plurality of adapters can be provided having differently sized second openings, the funnel can be connected to receiving containers having various sized openings.

Because the lid is provided, the funnel can be attached to the receiving container and transported without risk of spillage.

Still further features and advantages will become apparent from the ensuing description and drawings.

DETAILED DESCRIPTION

Figure 1:
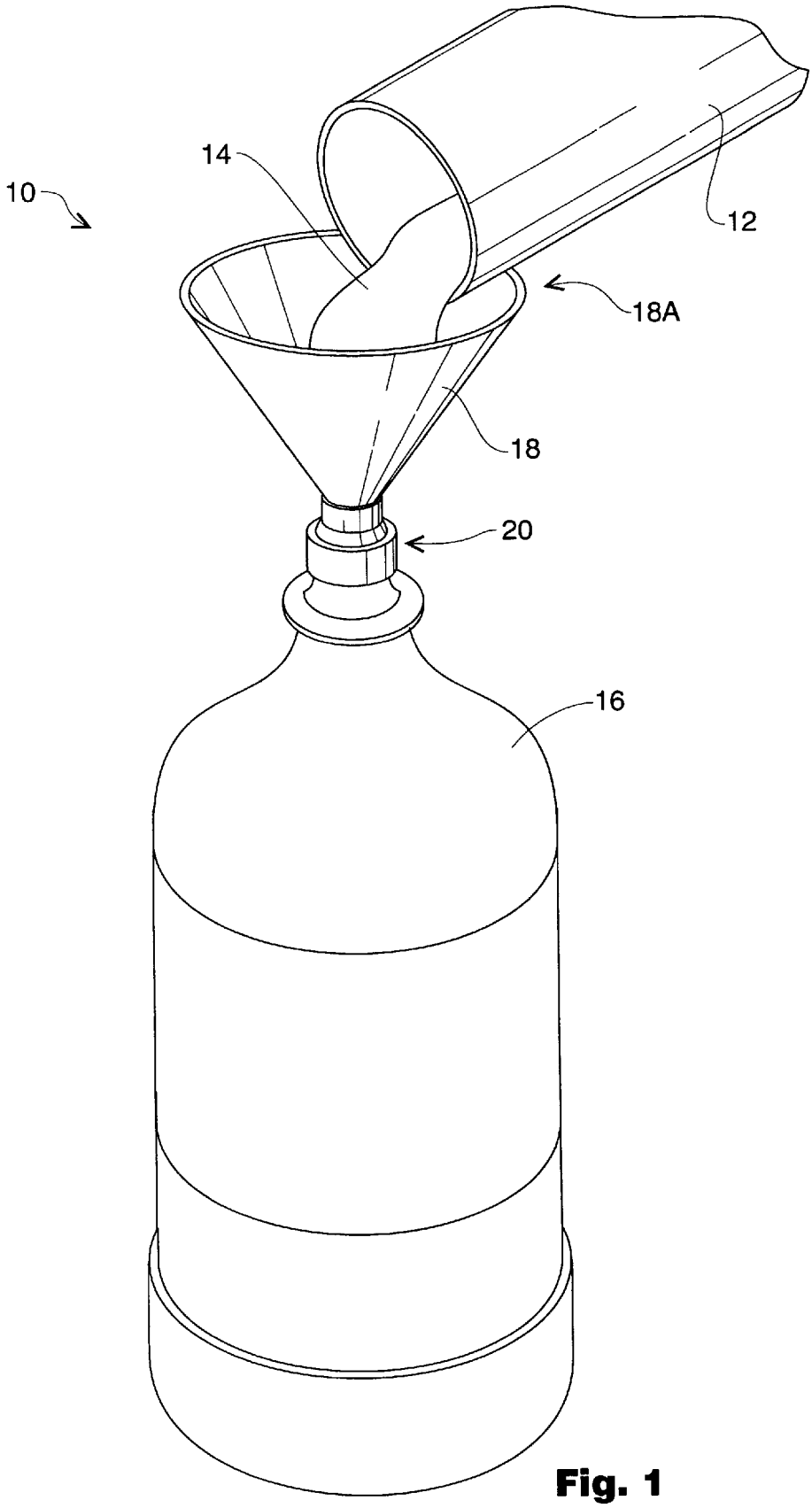
FIG. 1 is a perspective view of the funnel of the present invention in use.

FIG. 1 is a perspective view of a funnel 10 of the present invention in use. A first container 12 is shown pouring a substance 14 through the funnel 10 into a receiving container 16.

Figure 2:
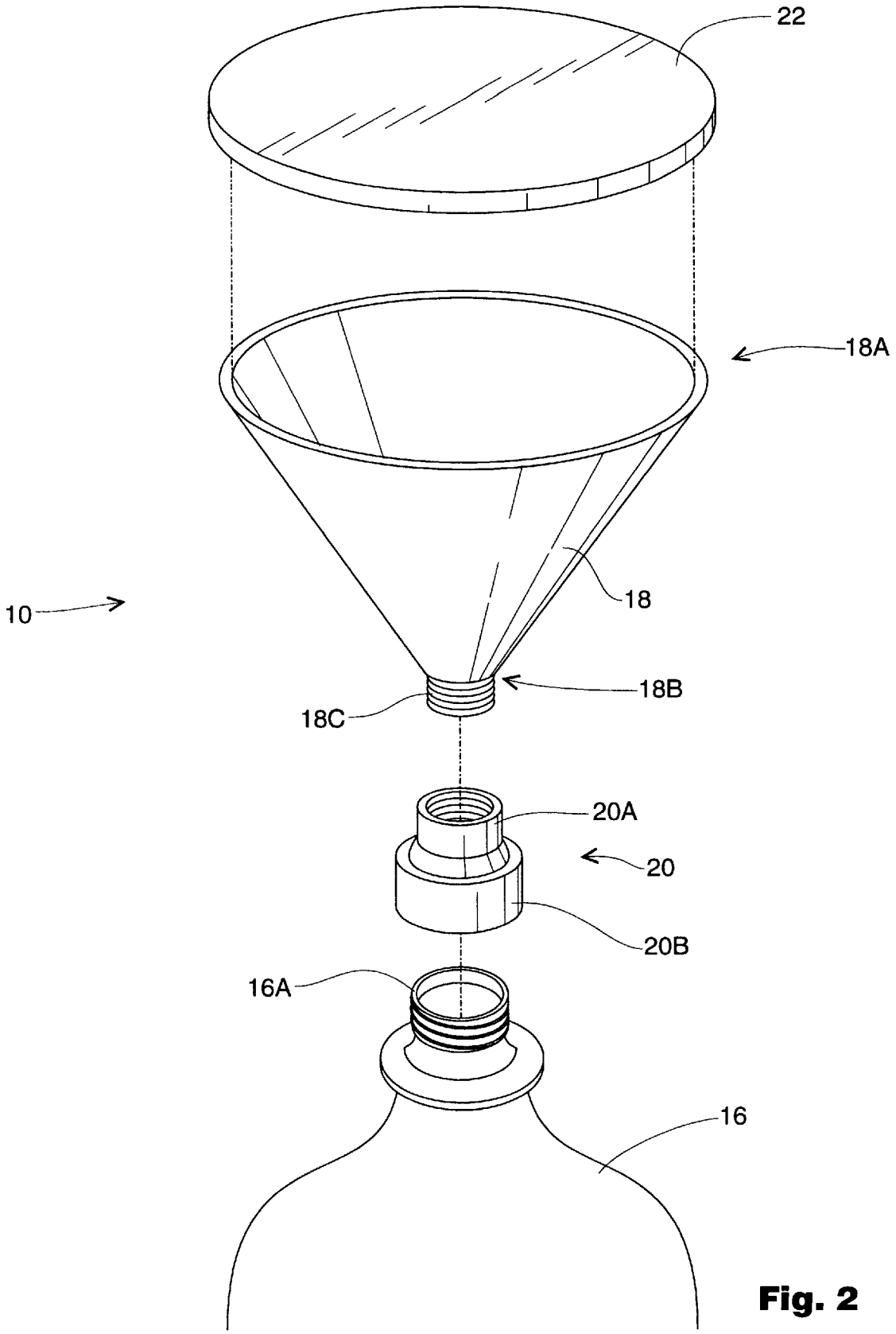
FIG. 2 is an exploded perspective view of the funnel and the receiving container.

FIG. 2 is an exploded perspective view of the funnel 10 and the receiving container 16. Referring to FIGS. 1 and 2, the funnel 10 of the present invention includes a substantially cone shaped body 18 comprising a top body opening 18A and a bottom body opening 18B. The top body opening 18A is larger than the bottom body opening 18B. A generally tubular threaded neck 18C extends outwardly from the bottom body opening 18B.

An adapter 20 has a threaded first end 20A configured to removably mate with the neck 18C. The adapter 20 has a threaded second end 20B adapted to removably mate with a receiving container opening 16A. When the adapter 20 is mated with the neck 18C and with the receiving container opening 16A, the bottom body opening 18B is in fluid communication with the receiving container opening 16A. A lid 22 is configured in a known manner to removably cover the top body opening 18A.

Figure 2A:
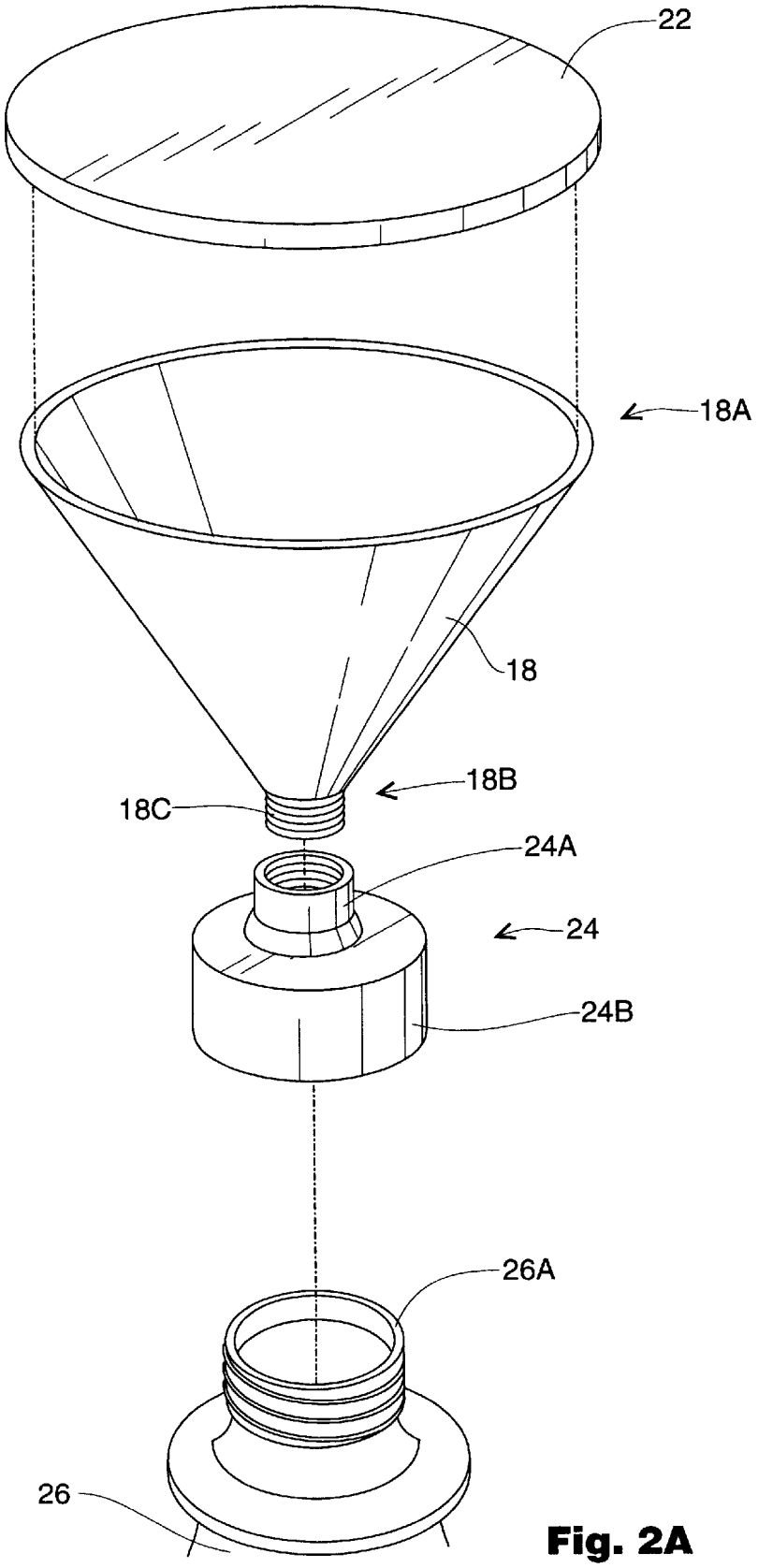
FIG. 2A an exploded view of a second adapter and a second receiving container.

FIG. 2A an exploded view of a second adapter 24 and a second receiving container 26. The second adapter 24 has a second adapter first end 24A configured to connect to the neck 18C, and being the same size as the first end 20A shown in FIGS. 1 and 2. A second adapter second end 24B is configured to connect to a second receiving container opening 26A, which is larger than the receiving container opening 16A shown in FIG. 2. This figure illustrates that a plurality of adapters can be provided for connecting the body 18 to receiving containers having openings of different sizes.

The foregoing description is included to describe embodiments of the present invention which include the preferred embodiment, and is not meant to limit the scope of the invention.

From the foregoing description, many variations will be apparent to those skilled in the art that would be encompassed by the spirit and scope of the invention. For example, and not by way of limitation, the neck of the funnel may be configured to connect directly to the receiving container opening, without the use of an adapter. In this embodiment, the funnel could not be used with a variety of receiving containers having differently sized openings, and it would probably be necessary to provide the funnel together with a matched receiving container, to the consumer.

Accordingly, the scope of the invention is to be limited only by the following claims and their legal equivalents.

The invention claimed is:

1. A funnel comprising:

a. a substantially cone shaped body having a top body opening and a bottom body opening, the top body opening being larger than the bottom body opening;

b. a generally tubular neck extending outwardly from the bottom body opening;

c. a first adapter and a second adapter, each of the first and second adapters having a first end configured to removably mate with the neck;

d. the first adapter having a first adapter second end, and the second adapter having a second adapter second end;

e. the first adapter second end adapted to removably mate with a first receiving container opening;

f. the second adapter second end adapted to removably mate with a second receiving container opening which is of a different size than the first receiver container opening;

g. wherein when the first adapter is mated with the neck and with the first receiving container opening, the bottom body opening is in fluid communication with the first receiving container opening, and when the second adapter is mated with the neck and with the second receiver container opening, the bottom body opening is in fluid communication with the second receiver container opening; and h. wherein the neck, the first end and the second end of the first adapter, and the first end and the second end of the second adapter are threaded.

2. The funnel of claim 1, further comprising a lid for removably covering the top body opening.

* * * * *